US005181757A

United States Patent [19]

Montoya

[11] Patent Number: 5,181,757

[45] Date of Patent: Jan. 26, 1993

[54] PLASTIC BAG CARRIER

[76] Inventor: Arturo T. Montoya, 7985 SW. 86th St., Apt. 410, Miami, Fla. 33413

[21] Appl. No.: 796,657

[22] Filed: Nov. 25, 1991

Related U.S. Application Data

[63] Continuation-in-part of Ser. No. 683,031, Apr. 11, 1991, Pat. No. Des. 325,169, which is a continuation-in-part of Ser. No. 592,903, Oct. 4, 1990, abandoned.

[51] Int. Cl.[5] ..... B65D 33/06

[52] U.S. Cl. ..... 294/159; 294/170

[58] Field of Search ..... 294/159, 158, 170, 171; D9/434; 383/13, 25

[56] References Cited

U.S. PATENT DOCUMENTS

| | | | |
|---|---|---|---|
| D. 290,935 | 7/1987 | Williams . | |
| D. 295,727 | 5/1988 | Clarke . | |
| 2,428,906 | 10/1947 | Cannella | 294/159 X |
| 3,083,366 | 3/1963 | Franges | 294/171 |
| 3,302,837 | 2/1967 | Montgomery | 294/159 X |
| 3,657,765 | 4/1972 | Geisinger . | |
| 3,679,103 | 7/1972 | Chmela et al. . | |
| 3,680,752 | 8/1972 | Wilson . | |
| 4,590,640 | 5/1986 | Enersen . | |
| 4,596,397 | 6/1986 | Conti | 383/13 X |
| 4,735,313 | 4/1988 | Schoenberg | 294/159 X |
| 4,841,596 | 6/1989 | Fink | 294/170 X |
| 5,060,998 | 10/1991 | Phillips | 294/159 X |

FOREIGN PATENT DOCUMENTS

| | | | |
|---|---|---|---|
| 3819580 | 12/1989 | Fed. Rep. of Germany | 294/171 |
| 2541099 | 8/1984 | France | 294/170 |

*Primary Examiner*—Margaret A. Focarino
*Assistant Examiner*—Dean J. Kramer
*Attorney, Agent, or Firm*—Richard C. Litman

[57] ABSTRACT

A plastic bag carrier for carrying plastic bags having one or more loops or handles. The plastic bag carrier includes a horizontal upper handle section joined to a parallel lower support section by a vertical web member. The handle has more than four finger indentation along its bottom surface to provide an adjustable grip for the user. The lower support section has a plurality of captive openings spaced equidistantly apart, for receiving the handles of plastic bags. One captive opening is centrally located along the top of the lower support section. In addition, one captive opening is located adjacent the front of the lower support section and one captive opening is located adjacent the rear to the lower support member. Each captive opening is provided with at least one keeper knob thus to form a retention clip, to restrict the passage of the plastic bag loop or handle into and out of the captive opening. This establishes a snap fit configuration for attaching the bags which maintains control over the bags in an organized fashion and provides greater comfort than carrying the bags by their respective handles.

1 Claim, 1 Drawing Sheet

PLASTIC BAG CARRIER

CROSS-REFERENCE TO RELATED APPLICATION

This application is a continuation-in-part of application Ser. No. 07/683,031 filed Apr. 11, 1991 now U.S. Pat. No. Des. 325,169 which is a continuation-in-part of application Ser. No. 07/592,903 filed Oct. 4, 1990 now abandoned.

BACKGROUND OF THE INVENTION

1. Field of the Invention

The present invention relates to a plastic bag carrier for carrying plastic bags that include one or more loops.

2. Description of Prior Art

Plastic bags are gaining popularity by retail establishments. Some businesses, such as grocers, offer plastic bags as an alternative to paper bags. Other businesses provide only plastic bags having no alternative available. Most of these plastic bags are of the type having one or more plastic loops or handles. If a shopper has made several purchases from a variety of stores or has purchased numerous items from a single concern, he or she may find in their possession several plastic bags to maintain. It becomes quite a cumbersome job to keep up with an abundance of plastic bags not to mention seemingly countless handles. This becomes quite evident if the user has a desire to temporarily set the group of plastic bags down. A plastic bag carrier would support a small group of plastic bags by their handles or plastic loops providing a single handle for the user to grip. A plastic bag carrier should provide a snap fit mechanism which would retain a group of plastic bags in the event the carrier is rested on a surface.

There are plastic bag carriers which carry plastic bags. No device, however, has yet been created which provides captive opening which holds an assembly of bags if they are momentarily rested on a surface.

U.S. Pat. No. Des. 295,727 issued May 17, 1988 to Francis A. Clarke discloses a bag holder including a substantially horizontal handle having a plurality of indentations joined by a substantially perpendicular section to a substantially parallel support member.

U.S. Pat. No. Des. 290,935 issued Jul. 21, 1987 to Charles G. D. Williams shows a handle for packages including a horizontal handle having a plurality of indentations.

U.S. Pat. No. 4,590,640 issued May 27, 1986 to Richard W. Enersen illustrates a handle for carrying a single plastic shopping bag that includes a recess for receiving the two loops of the bag.

U.S. Pat. No. 3,680,752 issued Aug. 1, 1972 to Glenn C. Wilson discloses a carrier handle for a pair of paint cans or a single paint can, the handle suspending the paint cans or can by the can bails or bail.

U.S. Pat. No. 3,679,103 issued Jul. 25, 1972 to John F. Chmela et al describes a combination carrying handle to be used with paint cans or packages.

U.S. Pat. No. 3,657,765 issued Apr. 25, 1972 to George H. Geisinger discloses a handle to carry a package by engaging the package binding cord.

None of the above inventions and patents, taken either singly or in combination, is seen to describe the instant invention as claimed.

SUMMARY OF THE INVENTION

The present invention relates to plastic bag carrier for carrying multiple plastic bags, each having one or more plastic loops or handles. The plastic bag carrier includes an upper handle having a number of finger indentations which are grasped by the users hand, a substantially horizontal lower support section which is substantially parallel to the upper handle, and a vertical web section which joins the upper handle and the lower support section to form generally a C-shaped configuration. Three restrictive passages are provided spaced equidistantly apart along a horizontal axis. These restrictive passages each include a captive opening which provides a snap fit for the handle or plastic loop of the plastic bag. A center restrictive passage is furnished to accommodate the heaviest bag, a restrictive passage adjacent the vertical support section is provided to contain the lightest bag, and a restrictive opening focal to the forward end of the lower horizontal support section may oblige any bag. A distal end of the handle portion includes a tactile sensing means which offers a feeling for the users hand location with respect to the orientation of the device. More than four finger indentations are provided along the bottom surface of the handle to enable the user to shift his or her hand location to alter his or her grip. The unique combination of the weight distribution of the plastic bags, the capability to alter the grip, and the tactile sensation offers a comfortable grasp to the user and a more manageable handling of the plastic bags. Moreover, the captive opening provides snap fit engagement of the bag plastic loop handle or handles which retains the plastic bags until the user manually releases the handles from the restrictive passages. Should the assembly of the carrier and multiple bags be rested on a surface and released, the bag loops will remain locked to the carrier so the user may pick up the entire assembly again without worry that one or more bags may have been released.

Accordingly, one object of the present invention is to provide a plastic bag carrier for carrying plastic bags having one or more handles or plastic loops.

Another object of the present invention is to provide a plastic bag carrier which provides a balanced weight distribution.

Another object of the present invention is to provide a plastic bag carrier which provides a snap fit configuration for retaining the bags.

A further object of the present invention is to provide a plastic bag carrier which provides a tactile sensing means to enable the user to sense the location of the hand relative to the handle.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
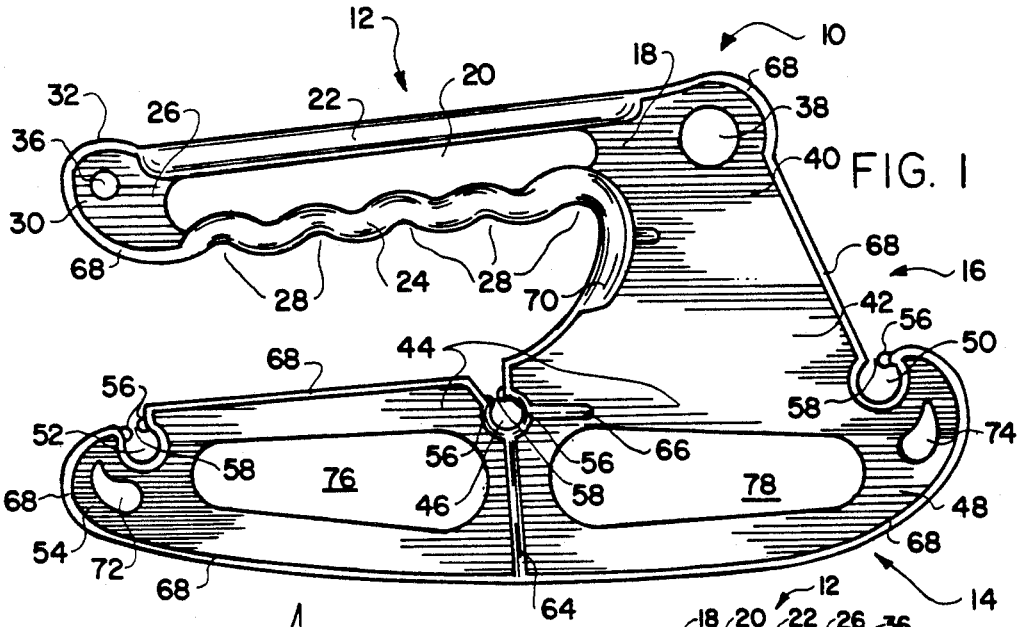
FIG. 1 is a side elevational view of the plastic bag carrier according to the present invention, the opposite side being a mirror image thereof.

Referring now to the drawings, FIG. 1 shows the plastic bag carrier 10 according to the present invention. The plastic bag carrier 10 is a substantially C-shaped configuration having a substantially horizontal upper handle section 12 and a substantially parallel lower support section 14 joined by a transverse web section 16.

The rear portion 18 of the upper handle section 12 is connected substantially perpendicular to the upper portion of the transverse web section 16 in cantilever fashion. The upper handle section 12 includes a longitudinally ascending opening 20 having a periphery defined at the top and the bottom by an inside surface of the upper and lower portions 22,24 of the upper handle sections 12 and defined at the front and rear by and inside surface of the front and rear portions 26, 18 of the upper handle section 12. The upper portion 22 of the upper handle section 12 is a solid elongated, generally round member. The lower portion 24 of the upper handle section 12 is a solid, irregularly shaped member having finger indentations 28 along the bottom surface. The upper portion 22 of the upper handle section 12 further comprises adjacent the distal end 30 a raised portion 32 to provide the user a tactile indication awareness of where one's hand 34 (shown in FIG. 3) should be placed with respect to the plurality of finger indentations or depressions 28 along the bottom surface of the lower portion 24 of the upper handle section 12. With further reference to FIG. 1, it will be noted that five finger depressions 28 are provided. This is so that the user may shift the four fingers of the hand forwardly or rearwardly to comfortably balance the load imparted by the bags suspended from the carrier. Furthermore, the reason for opening 20 is so that portion 24 may move upward slightly in use, in spring-like fashion, for further hand and finger comfort for the user. Another use for opening 20 is discussed below.

A front upper aperture 36 is disposed adjacent the distal end 30 of the upper handle section 12 and a rear upper aperture 38 is disposed where the rear portion 18 of the upper handle section 12 intersects with the upper portion 40 of the transverse support 16. These apertures 36, 38 permit the plastic bag carrier to be stored or suspended from a hook or the like (not shown) when not in use.

The lower portion 42 of the transverse web section 16 is joined substantially coplanarly with the upper portion 44 of the lower support section 14. The transverse web section 16 is generally triangular in shape, the triangular configuration being defined by aperture 38 and plastic bag loop or handle captive openings 46 and 50.

The central captive support 46 is located at the approximate horizontal center of the lower support section 14 with the rear captive opening 50 adjacent the rear portion 48 of the lower support section 14 and a front captive opening 52 located adjacent the front portion 54 of the lower support section 14. The front, central, and rear captive supports 46,50,52 are spaced generally equidistantly apart along the horizontal length of lower support section 14.

Figure 3:
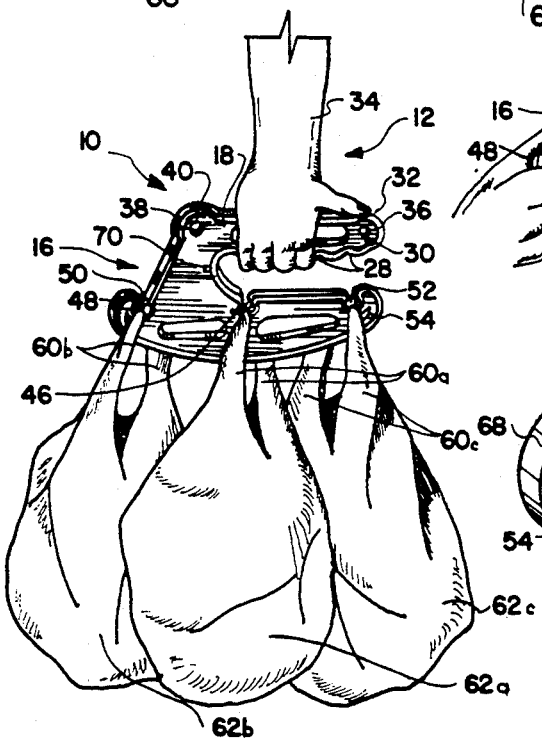
FIG. 3 is a side environmental perspective view of the plastic bag carrier according to the present invention showing the device in use.
Figure 2:
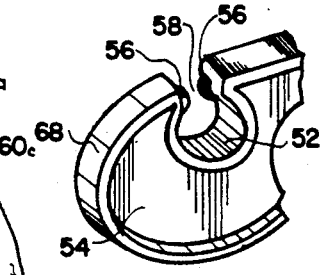
FIG. 2 is a detail perspective view of the plastic bag carrier according to the present invention showing the captive opening.

The front, central, and rear captive openings 46,50,52 include a retention knob 56 (also shown in FIG. 2) providing a restrictive passage 58 which forms a snap fit retention clip for the releasable engagement of a handle or plastic loop 60 of a plastic bag 62 (shown in FIG. 3).

A substantially vertical reinforcement rib projection 64 protrudes from the vertical plane of the lower support section 14 and a second substantially horizontal rib reinforcement projection 66 protrudes from the lower support section 14. The vertical and horizontal rib projections 64, 66 provide vertical and horizontal structural reinforcement.

Front and rear tear drop shaped apertures 72,74 are disposed adjacent the front and rear of the lower support section 14, respectively. Essentially oval front and rear apertures 76,78 are also provided through lower support section 14. The apertures 72,74,776,78 are primarily decorative in nature but also provide for reduced material requirements in manufacture of the bag carrier 10.

A lateral ridge 68 encircles the periphery of the plastic bag carrier 10 joining the upper and lower portion 22,24 of the upper handle section 12 at the front portion 26 of the upper handle section 12 as well as the rear portion 18 of the upper handle section 12 and the throat 70. The throat 70 is arranged between the lower surface of the lower portion 24 of the upper handle section 12 and the upper portion 44 of the lower support section 14. The distal end 30 is convex in shape. The upper portion 22 of the upper handle section 12 is substantially straight. The bottom surface of the plastic bag carrier 10 is in the shape of a sled runner, connected at one end to the front captive opening 52 and connected at an opposite end to the rear captive opening 50. The upper portion 44 of the lower support section 14 between the front captive opening 52 and the central captive opening 46 is substantially straight. The throat 70, being substantially concave, extends upwardly from the central captive opening 46 to the lower portion 24 of the upper handle section 12.

Again, and with reference to FIG. 1 in particular, it is noted that the structural elements described appear in mirror image fashion on the opposite side of bag carrier 10.

FIG. 3 shows the plastic bag carrier 10 in use. The plastic bags 62 are distributed along the lower support section 14 with the central captive opening 46 retaining a central plastic bag 62*a* in suspension by its respective plastic loop 60*a*, the rear captive opening 50 retaining a rear plastic bag 62*b* in suspension by its respective plastic loop 60*b*, and the front captive opening retaining a front plastic bag 62*c* by it respective plastic bag loop 60*c*. The central plastic bag 62*a* is preferably the heaviest one; the rear plastic bag 62*b* is preferably light, and the front plastic bag 62*c* is either heavy or light. The plastic bag carrier 10 is lifted by the upper handle section 12. The plurality of finger indentations 28 permit the hand 34 to shift along the upper handle section 12 alternating the grip in accordance with the distribution of the plastics bags 62*a*, 62*b*,62*c*. The raised portion 32 provides a feel for the hand 34 location relative to the finger indentations 28. The combination of the proper weight distribution and the location of the hand 34 along the upper handle section 12 provides optimum comfort and control.

Figure 4:
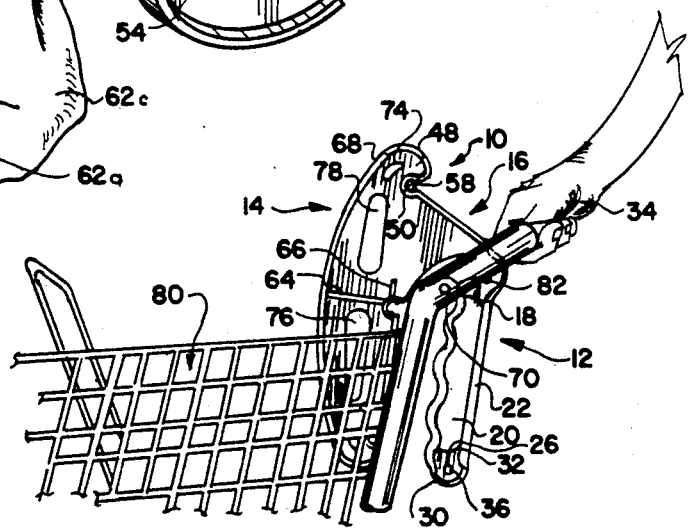
FIG. 4 is a side environmental view of the plastic bag carrier according to the present invention showing the carrier in further use while shopping.

FIG. 4 illustrates a manner in which the plastic bag carrier 10 may be stored while the shopping. The user simply hangs the plastic bag carrier 10 on the rear, horizontal edge 82 of the basket of a shopping cart 80, against the throat 70. Furthermore, the opening 50 may conveniently serve as a clip for temporary storage of shopping coupons and/or a shopping list.

Figure 5:
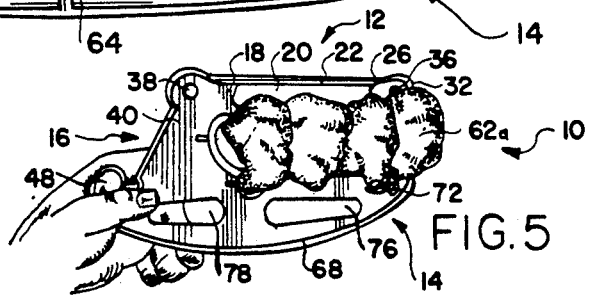
FIG. 5 is a side environmental perspective view of the plastic bag carrier according to the present invention showing the device storing a plurality of empty plastic bags.

FIG. 5 shows the storage of empty plastic bags 62 in the plastic bag carrier 10. This is best accomplished by inserting a plurality of empty plastic bags 62*b*,62*c* into a single empty plastic bag 62*a*. The provides a reminder to return recyclable plastic bags to their proper place when returning on the next shopping excursion.

The carrier is of integral, one-piece construction as shown in the drawings and, preferably, is made of suitable plastics material by injection molding or by any other suitable known method. Alternatively, the carrier 10 could be made of light-weight metal, aluminum for example, if desired.

It is to be understood that the present invention is not limited to the sole embodiment described above, but encompasses any and all embodiments within the scope of the following claims.

I claim:

1. A shopping bag carrier for suspending a plurality of shopping bags, each shopping bag having a bag handle or handles, said bag carrier comprising:

an upper, graspable, generally horizontal handle member including a plurality of finger receiving indentations therealong which are more than four in number whereby, in use, the hand of a user may be adjusted along said handle member to balance a bag load suspended from said carrier, said handle member further comprises means defining an elongated opening in and through said handle member, thus to define upper and lower handle member portions, said finger receiving indentations being formed on a lower surface of said lower handle member portion, said lower handle member portion being made of slightly resilient material whereby it may bend slightly for user hand comfort when said carrier is in use, suspending a plurality of bags;

a lower, extended length bag support member means for suspending a plurality of shopping bags or the like therefrom;

a transverse web interconnecting said handle member and said bag support member means; and said bag support member means further comprising a first, generally centrally located captive opening means within which a handle or handles of a shopping bag may be placed, and a second captive opening means displaced horizontally apart from said first captive opening means, within which a handle or handles of an additional shopping bag may be placed, said bag support member means further comprises a third captive opening means for supporting yet an additional shopping bag by its handle or handles, and being horizontally spaced apart from said first captive opening means and oppositely from said second captive opening means, said second and third opening means being disposed substantially equidistantly from, and to either side of, said first captive opening means.

* * * * *